US005765483A

United States Patent [19]

Klenk et al.

[11] Patent Number: 5,765,483

[45] Date of Patent: Jun. 16, 1998

[54] DEVICE FOR AUTOMATIC FORMAT ADJUSTMENT IN A DELIVERY OF A ROTARY PRINTING PRESS

[75] Inventors: Rainer Klenk, St. Leon-Rot; Bernhard Waltenberger, Mannheim, both of Germany

[73] Assignee: Heidelberger Druckmaschinen AG, Heidelberg, Germany

[21] Appl. No.: 825,494

[22] Filed: Mar. 28, 1997

[30] Foreign Application Priority Data

Mar. 28, 1996 [DE] Germany ..... 196 12 293.7

[51] Int. Cl.[6] ..... B41F 13/64

[52] U.S. Cl. ..... 101/239; 271/225; 271/226; 271/229; 271/233

[58] Field of Search ..... 101/239, 236, 101/237, 238; 271/3.01, 3.02, 4.01, 4.05, 4.06, 4.07, 4.08, 233, 225, 226, 229, 241, 245

[56] References Cited

U.S. PATENT DOCUMENTS

| | | | |
|---|---|---|---|
| 912,244 | 2/1909 | Ielfield | 101/239 |
| 3,949,979 | 4/1976 | Taylor et al. | 271/345 |
| 4,189,140 | 2/1980 | Swanson | 271/212 |
| 5,240,244 | 8/1993 | Pollich et al. | 271/240 |
| 5,696,690 | 12/1997 | Richardson et al. | 271/3.01 |

FOREIGN PATENT DOCUMENTS

| | | |
|---|---|---|
| 31 12 672 C1 | 6/1983 | Germany . |
| 42 24 010 A1 | 2/1993 | Germany . |

*Primary Examiner*—Eugene H. Eickholt

*Attorney, Agent, or Firm*—Herbert L. Lerner; Laurence A. Greenberg

[57] ABSTRACT

A device for a format-dependent adjustment of cut-off length in a delivery region of a rotary printing press having a device for nonstop operation, with stops for the trailing edge of the sheets to be delivered, includes a separating band revolving perpendicularly to the sheet transport direction, the separating band being integrated in a frame structure arranged so as to be displaceable in a horizontal direction, the stops for the sheet edge and a sheet-braking device being carried by the frame structure.

17 Claims, 6 Drawing Sheets

17
13
18
16
10
12
30
29
30
28
26
31
30
26
32
30
26
31
30
26
24.1
27
25.1
24
25.2
13
23
12
11

DEVICE FOR AUTOMATIC FORMAT ADJUSTMENT IN A DELIVERY OF A ROTARY PRINTING PRESS

BACKGROUND OF THE INVENTION

Field of the Invention

The invention relates to a device for the format-dependent adjustment of the cut-off or section length in the delivery region of a rotary printing machine whether with or without a device for nonstop operation.

The prior art, exemplified by the published German Patent Document DE 39 37 944 C1, has already disclosed a sheet delivery for a sheet-fed printing press. It describes a catching device for the sheet leading edge in the sheet delivery of a sheet-fed printing press, wherein there are provided stack or pile stops for the leading edge of the sheets conveyed beyond a sheet stack, the stops being capable of being folded away, and catching fingers, capable of being briefly pushed in relative to the sheet plane over the sheet pile from the sheet leading edge, to form an auxiliary pile and, moreover, corresponding drive members which cause the pile or stack stops to be folded away and unfolded again about a pivot shaft, oriented parallel to the sheet plane, as a function of the push-in movement or of the pull-back movement of the catching fingers. For this movement, separate motor drives, preferably pneumatic cylinders, for the movement of the pile or stack stops and of the catching fingers are arranged, respectively, on one of the two press sides of the delivery and act upon drive shafts mounted coaxially to one another transversely to the conveying direction of the sheet, transmission members for transmitting the rotational movement of one drive shaft to the pivot shaft of the pile or stack stops being arranged on one press side and transmission members for transmitting the rotational movement of the other drive shaft to linearly movably guided catching fingers being arranged on the other press side, and switching elements being provided for the individual drive of the two drive shafts and for the corresponding drive as a function of one another.

The published German Patent Document DE 39 41 993 C1 relates to a sheet feeder with an auxiliary sheet pile or stack for nonstop operation. A sheet feeder with an auxiliary stacking device for nonstop operation, wherein the auxiliary stack resting on carrying rods or a carrying rake is combined with the main stack which is capable of being lifted off, is provided, in the front region of the auxiliary stack, with a plurality of receiving fingers which are distributed over the sheet width and which can be moved into the pile or stack region in such a way that, when the auxiliary stack support is removed, the leading edge of the auxiliary stack or pile does not drop a distance corresponding to the thickness of the auxiliary stack support.

The published German Patent Document DE 42 17 816 A1 relates to a device for the continuous delivery of sheet-like printed sections. The invention described therein relates to a device for the continuous delivery of sheet-like printed products, in particular sections separated from a material web, the device having means for separating into a main stack and an auxiliary stack. Furthermore, a conveyor device is provided for a main stack. A lowerable auxiliary stacking unit includes both remote-controlled flexible means rotating perpendicularly to the direction of transport of sections and remote-controlled horizontally retractable and extensible carrying means for the specific separation of a continuously arriving stream of sections into a main stack or pile and an auxiliary stack or pile.

Although the devices of the prior art solve the problem of separating sheet stacks or piles into auxiliary and main stacks or piles on the feeder side or delivery side of a rotary printing press, they largely ignore reactions, occurring during format adjustments of individual components, on other components, for example, in the delivery of a rotary printing press.

SUMMARY OF THE INVENTION

In light of the prior art, it is an object of the invention to provide an improved sheet delivery for rotary printing presses, namely a device for automatic format adjustment in a delivery of a rotary printing press, so that, hereinafter, adjustment operations on individual components necessary for the sheet delivery may be dispensed with when the sheet format is changed.

With the foregoing and other objects in view, there is provided, in accordance with the invention, a device for a format-dependent adjustment of cut-off length in a delivery region of a rotary printing press having a device for nonstop operation, with stops for the trailing edge of the sheets to be delivered, comprising a separating band revolving perpendicularly to the sheet transport direction, the separating band being integrated in a frame structure arranged so as to be displaceable in a horizontal direction, the stops for the sheet edge and a sheet-braking device being carried by the frame structure.

In accordance with another feature of the invention, the adjustment device includes guiding elements for moving the frame structure on a horizontal guide.

In accordance with a further feature of the invention, the guiding elements are formed as runner rollers.

In accordance with an added feature of the invention, the horizontal guide member is formed with profiling.

In accordance with an additional feature of the invention, the guiding elements are formed as a prismatic guidance structure.

In accordance with yet another feature of the invention, the guiding elements are provided with needle cages.

In accordance with yet a further feature of the invention, the stops for the sheet edge are mounted on the frame structure.

In accordance with yet an added feature of the invention, the stops for the sheet edge are pivotally mounted on the frame structure.

In accordance with yet an additional feature of the invention, the frame structure includes a crossmember carrying the stops, and a common actuating device connecting the stops to one another.

In accordance with still another feature of the invention, the common actuating device is a Bowden wire.

In accordance with an alternative feature of the invention, the common actuating device is a connecting rod.

In accordance with still a further feature of the invention, the common actuating device is guidable in a longitudinal groove formed in the crossmember.

In accordance with still an added feature of the invention, the common actuating device has pins provided thereon, the pins engaging in orifices formed in the stops.

In accordance with still an additional feature of the invention, the common actuating device has at least one regulating cylinder assigned thereto, the regulating cylinder being activatable via a bistable valve and a monostable valve.

In accordance with another feature of the invention, the adjusting device includes deflecting rollers mounted within the frame structure, the separating band being revolvable on the deflecting rollers.

In accordance with a further feature of the invention, the frame structure includes side parts having projections serving as limit switch surfaces.

In accordance with a concomitant feature of the invention, the frame structure is engageable with a sheet pile in a paper sheet travel direction.

There are various types of advantages which can be achieved by the device according to the invention. By adjusting the central frame structure, whereon the components necessary for edge-accurate sheet delivery are mounted, an exact approach to a new position of the frame structure for a new sheet format to be delivered can be achieved at the pressing of a button. Because the auxiliary components are arranged on the frame structure at specific distances from one another, it becomes unnecessary to adjust these relative to one another, because they are moved automatically, together with the central frame structure, into the correct new operating positions thereof.

In a further embodiment of the idea upon which the invention is based, the central frame structure may be moved on a horizontal guide by guiding elements. In addition to runner rollers, which run on a profiled rail, a prismatic guide may also be provided. This prismatic guide may be constructed both with and without needle cages or ball boxes or the like.

The central frame structure is movable horizontally by a drive motor which acts upon a pulling device fastened to the frame structure. The pulling device may be a link chain, a roller chain, a rack guide or toothed belts or the like.

With limit switch surfaces provided on the frame structure and limit switches cooperating therewith, the respective end position of the central frame structure, that is, whether it is set in position for a maximum or a minimum deliverable format, may be interrogated. Intermediate positions between these two end positions are possible simply by making calculations of the necessary rotational speed of the motor/gear unit as a function of a reference position.

Integration of the separating device for pile separation, which is necessary in nonstop operation, into main and auxiliary piles provides the printer with an enormous amount of space and considerably improves access to the sheet pile. Moreover, the separation of the pile then takes place in the paper sheet travel direction and makes it unnecessary to push in a stack rake or the like opposite to the paper sheet travel direction. The attendant risk of damage to the sheets already delivered on the pile is then averted.

Because a sheet brake can also be mounted on the central frame structure, whenever format adjustments are required, this sheet brake too is moved, respectively, into the operative position thereof which is optimal for the new format.

Other features which are considered as characteristic for the invention are set forth in the appended claims.

Although the invention is illustrated and described herein as embodied in a device for automatic format adjustment in a delivery of a rotary printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
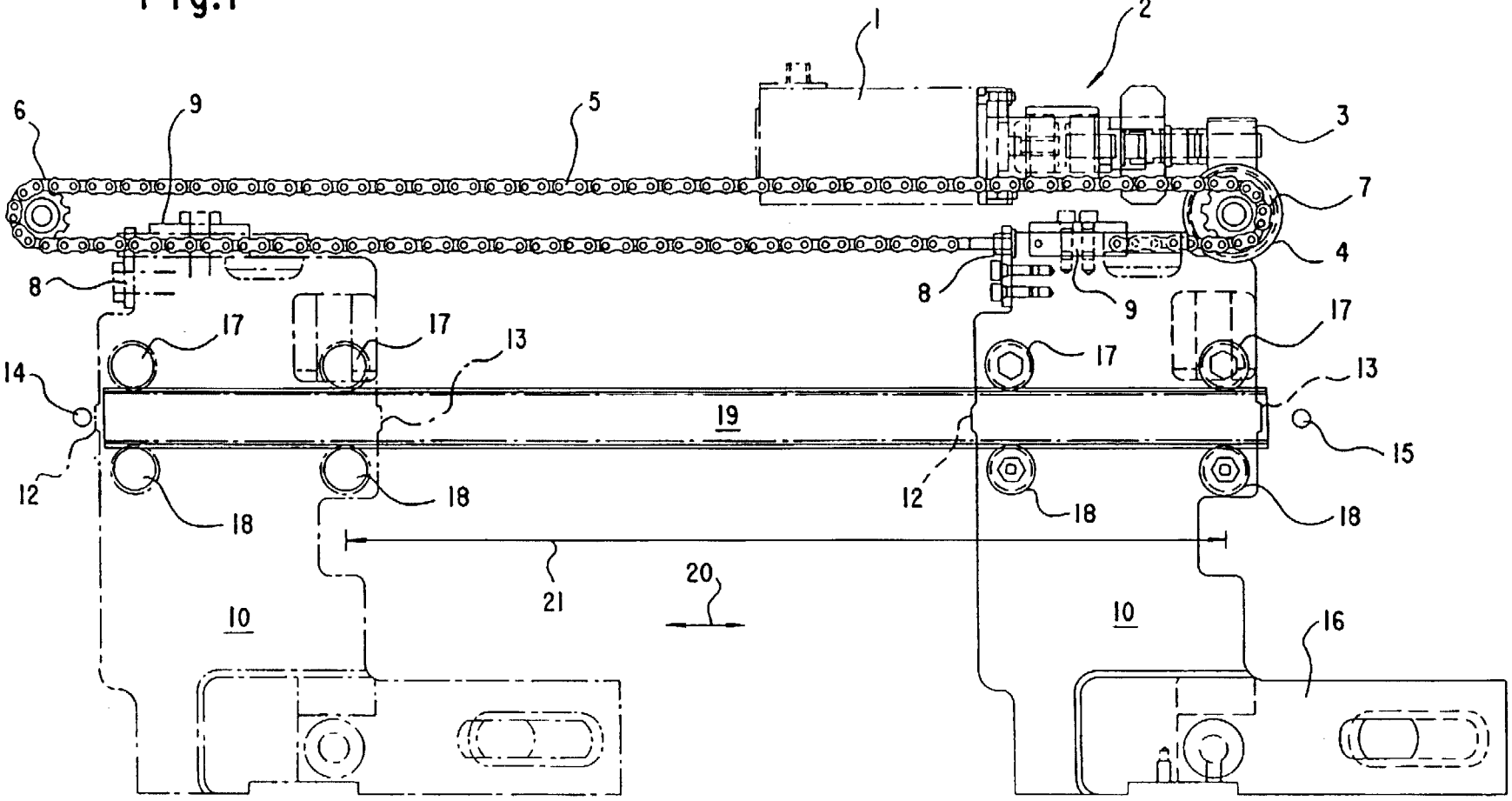
FIG. 1 is a side elevational view of the side parts which are displaceable on a guide profile and which are movable by a pulling device.

Referring now to the drawings and, first, particularly to FIG. 1 thereof, there is shown therein a side elevational view of the side parts which are displaceable on a guide profile and which are arranged so as to be movable in the horizontal direction by a pulling device.

A drive motor 1 is mounted on a side part of a sheet delivery of a rotary printing press and acts self-lockingly or irreversibly upon a gearwheel 3 via a gear 2. The gear 2 may be formed, for example, of a paired worm/worm wheel. The driving force provided by the drive motor 1 acts from the gearwheel 4 upon a deflecting wheel 6 which may be constructed, for example, as a chain wheel for a pulling device 5. The pulling device 5, shown herein in the form of a roller chain, revolves via two sprocket wheels or deflector wheels 6 and 7 and is articulatedly connected by respective front and rear pulling-device locks 8 and 9 on side parts 10, 11 of a central frame structure, of which only the side part 10 is illustrated in FIG. 1.

The side parts 10 and 11 are connected to one another by a crossmember 27 as well as a profile or profiled member 24 (note FIG. 3) and a crossmember 32, and form the central frame structure which is displaceable. Front and rear limit switch surfaces 12 and 13 are formed on the respective side parts 10 and 11 approximately level with the guiding elements 17 and 18. The limit switch surfaces 12 and 13 project somewhat relative to the vertically extending component edges of the side parts 10 and 11 and, during the horizontal displacement of the central frame structure, cooperate with limit switches 14 and 15 which are arranged on both sides of an elongated horizontal guide 19, respectively, at the ends thereof. In the case of the fully automatic operation of the rotary printing press, when the respective end positions are reached, the respective end position of the central frame structure can be indicated or displayed to the pressman.

The intermediate positions of the frame structure, which are located between the end positions indicatable or displayable, respectively, by the two limit switches 14 and 15 and which can be approached horizontally as a function of the sheet format, can be recorded by rotary transducers on the drive motor 1 and can be interrogated by the pressman, so that, if he does not have the delivery region of the rotary printing press in his field of vision, he is aware at all times of the adjustment of the central frame structure 10, 11, 24, 27, 32.

In the exemplary embodiment shown in FIG. 1, the therein non-illustrated side parts 10 and 11 are mounted on the horizontal guide 19 by an upper and a lower guiding element 17 and 18. Instead of the runner roller construction shown in FIG. 1, however, it is likewise possible to guide the side parts 10 and 11 in a prismatic guide so as to be largely free of play. This prismatic guide may be equipped with needle cages or alternatively also may not be equipped with needle cages. Ball boxes are an alternative to the use of needle cages. Through the use of the structural elements shown, the side parts 10 and 11 can be displaced horizontally so as to be largely free of play, a crossmember 27 (note FIG. 3), a crossmember 32 and a profile 24 providing a rigid frame structure which can absorb forces and moments in all spatial directions.

The double-headed arrow identified by the reference numeral 20 marks the horizontal displacement of the central frame structure, and the distance measured by the double-headed arrow 21 denotes the maximum negotiable horizontal displacement travel of the frame structure 10, 11, 24, 27, 32 on the horizontal guide 19.

A holding element 16 for fittings is provided in the lower region of the side parts 10 and 11. For example, a device for braking the sheets to be delivered may be carried by this holding element 16.

Figure 2:
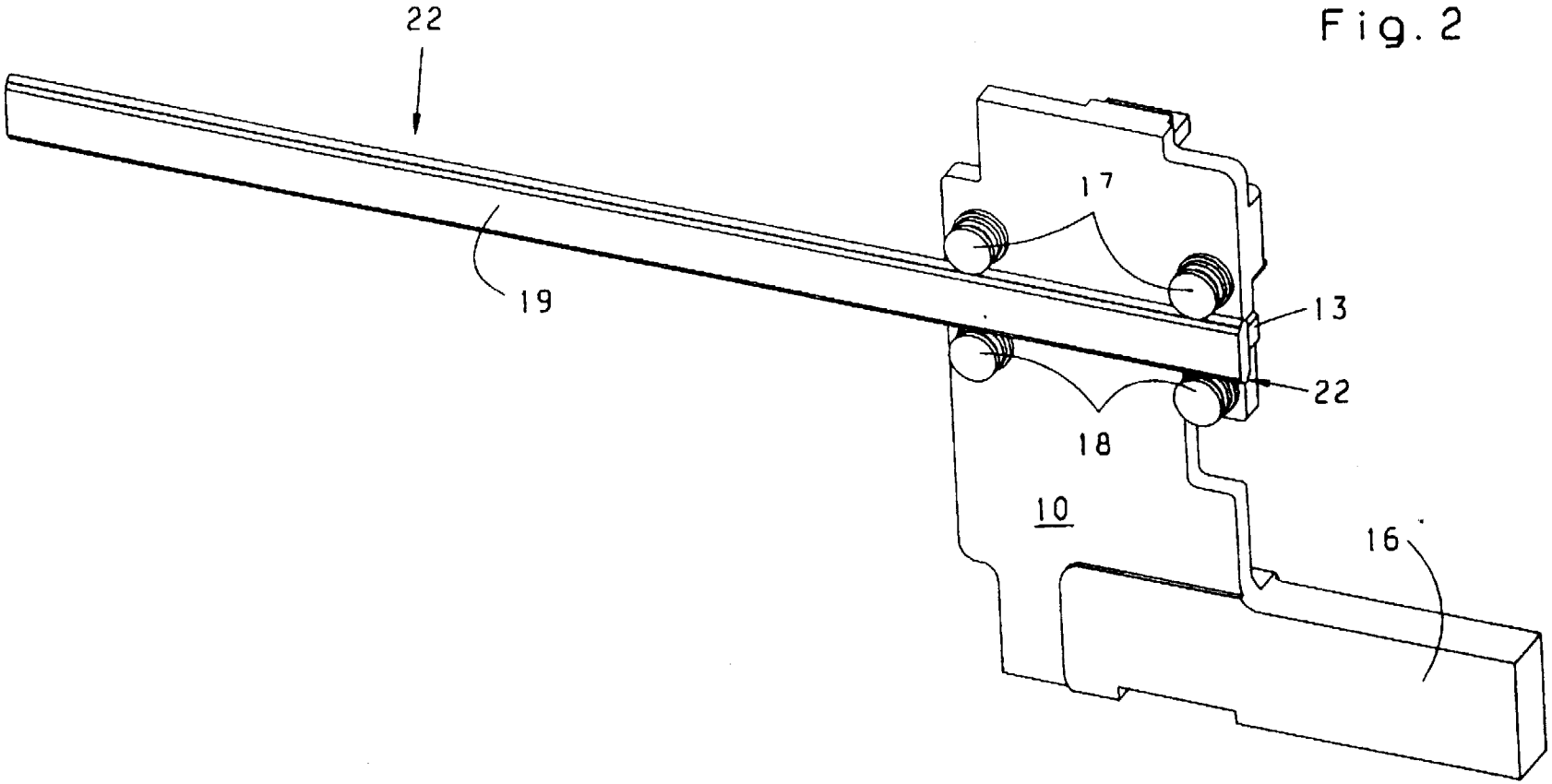
FIG. 2 is a top, left-hand side and right-hand end perspective view of the guide profile with correspondingly shaped guides.

FIG. 2 is a perspective view of the horizontal guide 19 which is equipped with profiling 22. The guiding elements 17 and 18 consequently have a configuration complementary to the profiling 22, so that they surround the horizontal guide 19 laterally, which is conducive to the accuracy and stability of the guidance provided thereby. The holding element 16 for additional fittings is illustrated in the lower right-hand corner of FIG. 2.

Figure 3:
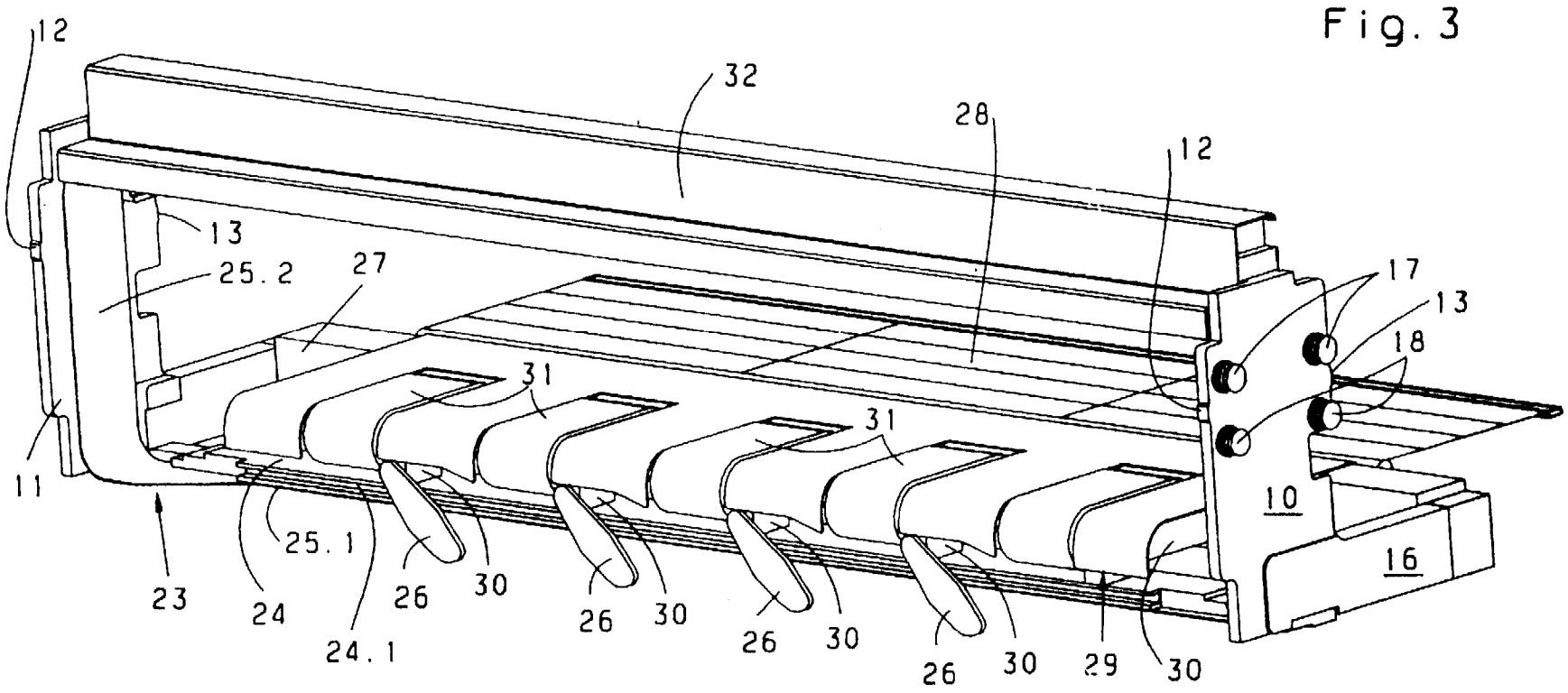
FIG. 3 is a top, left-hand side and right-hand end perspective view of an arrangement of the side parts connected to one another by crossmembers, with a separating band guide integrated in the side parts.

FIG. 3 is a perspective view of the side parts connected to one another by crossmembers, with an integrated separating band guide for nonstop operation.

The frame structure, which is formed of the side parts 10 and 11 and the crossmembers 27 and 32, extends over the width of the rotary printing press and is dimensioned to the width of the maximum processable sheet format. The limit switch surfaces 12 and 13 can be seen on the side parts 10 and 11. The limit switches 14 and 15 cooperating with the limit switch surfaces 12 and 13 are not illustrated in FIG. 3. The guiding elements formed as running rollers 17 and 18 in this embodiment of the invention and cooperating with the horizontal guide 19 are diagrammatically illustrated in FIG. 3. Fastened to bearing plates 30 provided underneath the frame structure 10, 11, 24, 27, 32 are trailing edge stops 26 which, in the embodiment of FIG. 3, are in a laterally inclined position. Located at the rear end of the holding element 16 for fittings is a roll-on/roll-off mechanism for a flexible cover 28 which spreads over the space freed under the drier of the rotary printing press when the frame structure moves between the cover and the end of the sheet guide zone. The roll-on/roll-off mechanism for the cover 28 is loaded by a return spring, so that the cover 28 is tautened optimally in any operating position of the frame structure 10, 11, 27, 32.

A separating band 25 is integrated into the frame structure 10, 11, 27, 32. The separating band 25 is formed with a narrow region 25.1 which is placed under the lower profile 24 in the position shown in FIG. 3. In the situation shown in FIG. 3, the widened separating edge 25.2 of the separating band 25 extends parallel to the side part 11, the transitional region between the separating edge 25.2 and the narrow region 25.1 being of trapezoidal form. The trapezoidal region could therefore be provided with a covering, in order to avoid damage to the sheet. Even thin coverings clamped onto the separating edge 25.2 would be conceivable, in order to avoid damage to the sheet to be delivered. The separating band 25 is guided by four deflecting rollers 40 integrated into the frame structure 10, 11, 27 and 32. The separating band 25 allows the separation of main and auxiliary stacks or piles during a nonstop operation in those rotary printing presses which are equipped for nonstop operation, and is moved by a pneumatic cylinder integrated into the crossmember 32 and having no piston rod. Because the separating band 25 is arranged at the trailing edge of the sheet pile or stack being formed, i.e., in the paper sheet travel direction, there is no need for a stack rake to be pushed in opposite to the paper sheet travel direction. Consequently, access to the stack or pile is improved, and the freedom of movement of the pressman is not restricted.

Furthermore, a device 29 for braking sheets to be delivered may be arranged on the frame structure 10, 11, 27, 32. This device 29 would be mounted on the crossmember 27 and would be limited laterally by the holding elements 16 for fittings. The sheet-braking device 29 per se is not the subject of the invention in the instant patent application.

The arrangement of the stops 26 at a correct distance or spacing from the sheet-braking device 29 ensures a clean-edge stack or pile formation even after format adjustment. When the separating edge 25.2 is moved inward for stack or pile separation, the stops 26 are pivoted upwards and thus allow the separating edge 25.2 to move inward (note also FIG. 5).

The automatically occurring horizontal adjustment of the frame structure in the case of format changeovers, i.e., when a change in an order is made during the printing of sheets of different dimensions, relieves the pressman of a series of adjusting and setting tasks, because they take place without the use of a tool and at only the pressing of a button. Auxiliary equipment, such as the sheet-braking device 29, are also adjusted automatically, and there is no need for any relative adjustments of the central frame structure 10, 11, 27 and 32 with respect to the sheet-braking device 29. Furthermore, it is unnecessary to bother about an adjustment of the stack-separating device, because this is integrated into the central frame structure and is automatically also moved during the displacement of the latter. The readjustment of the sheet trailing edge stops 26 after format adjustments may also be dispensed with. The distance or spacing thereof from the sheet-braking device 29 always remains the same and requires no correction. After the frame structure has been moved into a new position, the stops 26 are in the correct position, so that adjustment and setup time is spared and the formation of an edge-accurate sheet stack or pile occurs more rapidly.

Simultaneously with the adjustment of the central frame structure 10, 11, 27 and 32 to a new format, therefore, a separating device, present for possible nonstop operation and serving for forming the main and auxiliary stacks or piles, is adjusted into the correct position, as are also the trailing edge stops and the sheet brake 29. The sheet brake 29 has brake bands 31, arranged in a manner distributed over the sheet conveying plane and spaced from one another, as well as individual webs 30 extending next to the brake bands 31.

Figure 4:
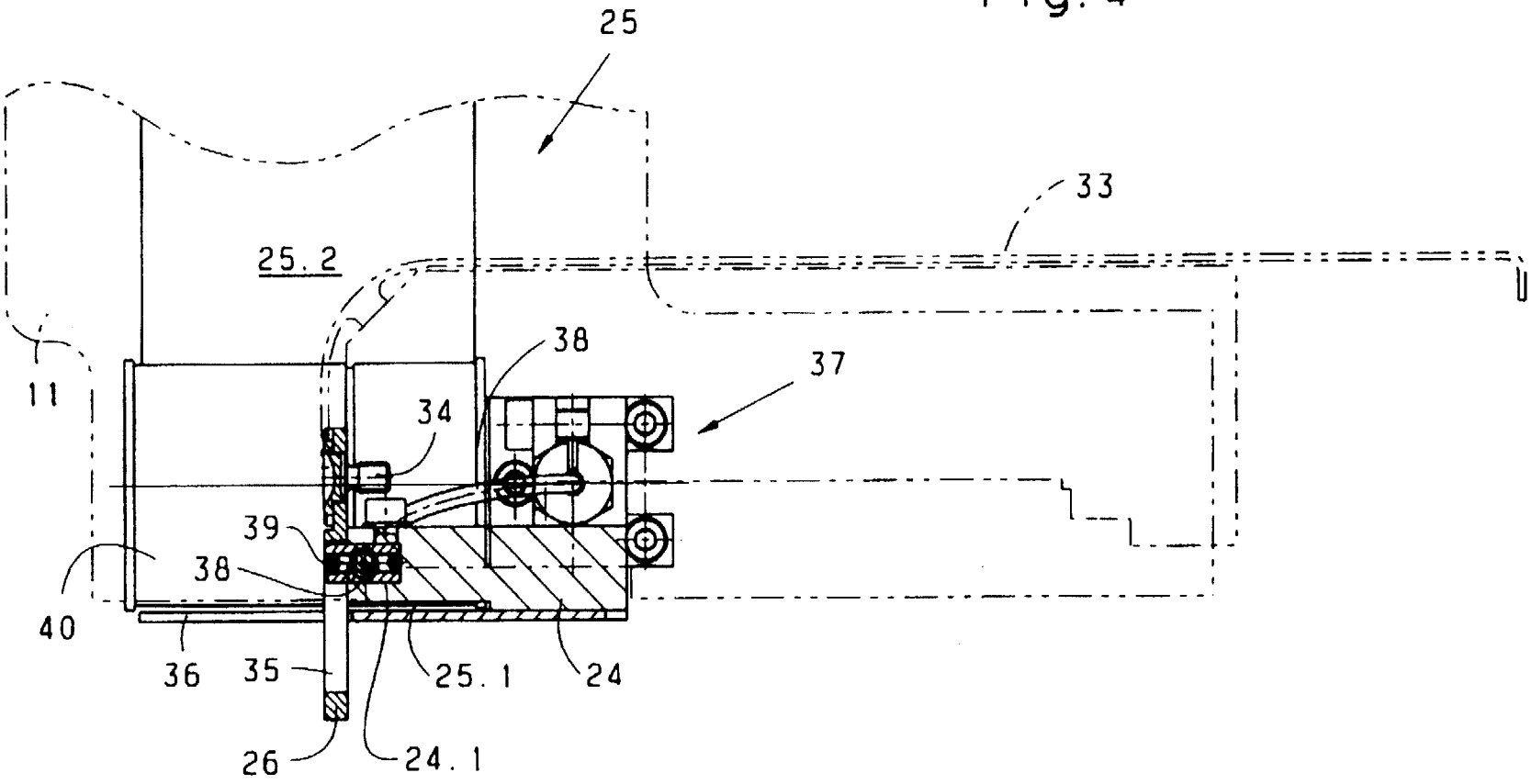
FIG. 4 is an enlarged fragmentary side elevational view of FIG. 3, partly in section along the line IV—IV shown in FIG. 5, providing details of a pivotal stop forming part of the invention.

FIG. 4 shows a pivotable stop in cross section. On the crossmember 24 which is formed with a longitudinal groove 24.1, a plurality of pivotable stops 26, one of which is illustrated in cross section, are distributed over the width of the crossmember 24 in the longitudinal groove 24.1.

The stops 26 are adjusted by a common actuating device, for example, a Bowden wire or control cable or a steel cable 38, via two pneumatic cylinders 37 which are mounted on the sides of the frame structure 10, 11, 24, 27, 32. A plurality of pins are fastened to the Bowden wire or steel cable 38, for example, by setscrews 39. The pins engage in longitudinal slots 35 formed in the stops 26, so that, in the event of a lateral movement of the Bowden wire or steel cable 38, a pivoting movement about the axis 34 is imparted to the stops 26. Furthermore, the cross-sectional view according to FIG. 4 shows how the narrow region of the separating band 25.1 is guided in the cross member 24 and how the separating band 25 extends in the vertical direction behind a deflecting roller 40 in front of the side part 11.

Provided underneath the crossmember 24 is a support plate 36 supporting the separating edge 25.2, which is movable into the stack or pile region, when the separating edge 25.2 is pressed downward due to the weight of the sheets during the buildup of the auxiliary stack or pile. A guide plate 33 is arranged above the crossmember 24.

Figure 5:
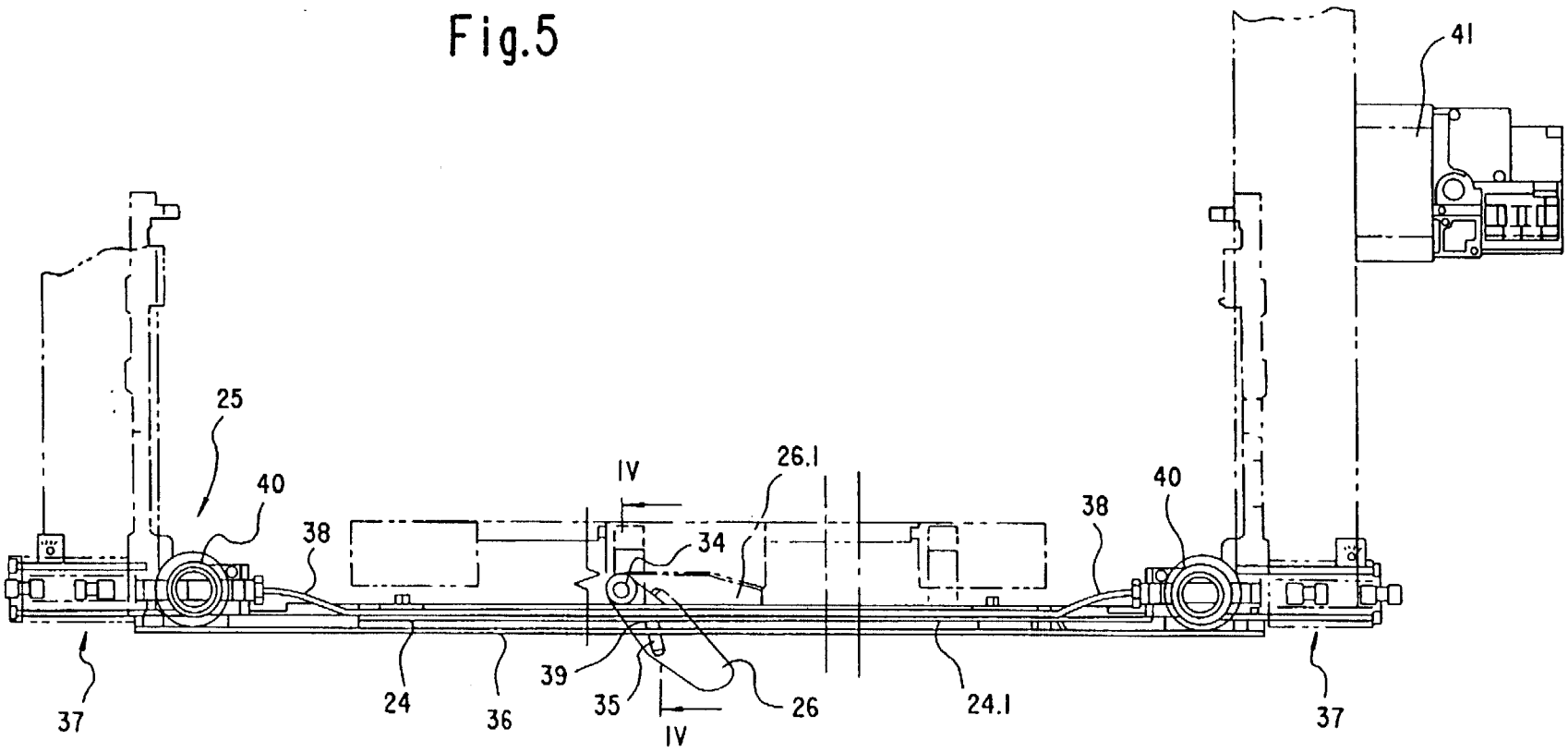
FIG. 5 is a front elevational view of a crossmember whereon the pivotal stops according to the invention are mounted, and two regulating or operating cylinders are provided.

FIG. 5 provides a front view of the crossmember 24 of the displaceable frame structure 10, 11, 24, 27, 32, together with a downwardly pivoted stop 26, the upwardly pivoted position 26.1 of which is represented by dot-dash or phantom lines. Only one stop 26 is shown by way of example in FIG. 5, but, of course, a plurality of these stops 26 can be installed on the crossmember 24. The Bowden wire 38 guided in the longitudinal groove 24.1 can be moved therein by the control or regulating cylinder 37. The setscrew 39, which engages in the longitudinal slot 35 of the stop 26 and pivots the latter into the position 26.1 thereof, can be seen in this view. The support plate 36, which supports the separating band 24, is shown underneath the crossmember 24 in FIG. 5. A pneumatic distributor 41, which will be discussed hereinafter, is mounted on a side wall.

Figure 6:
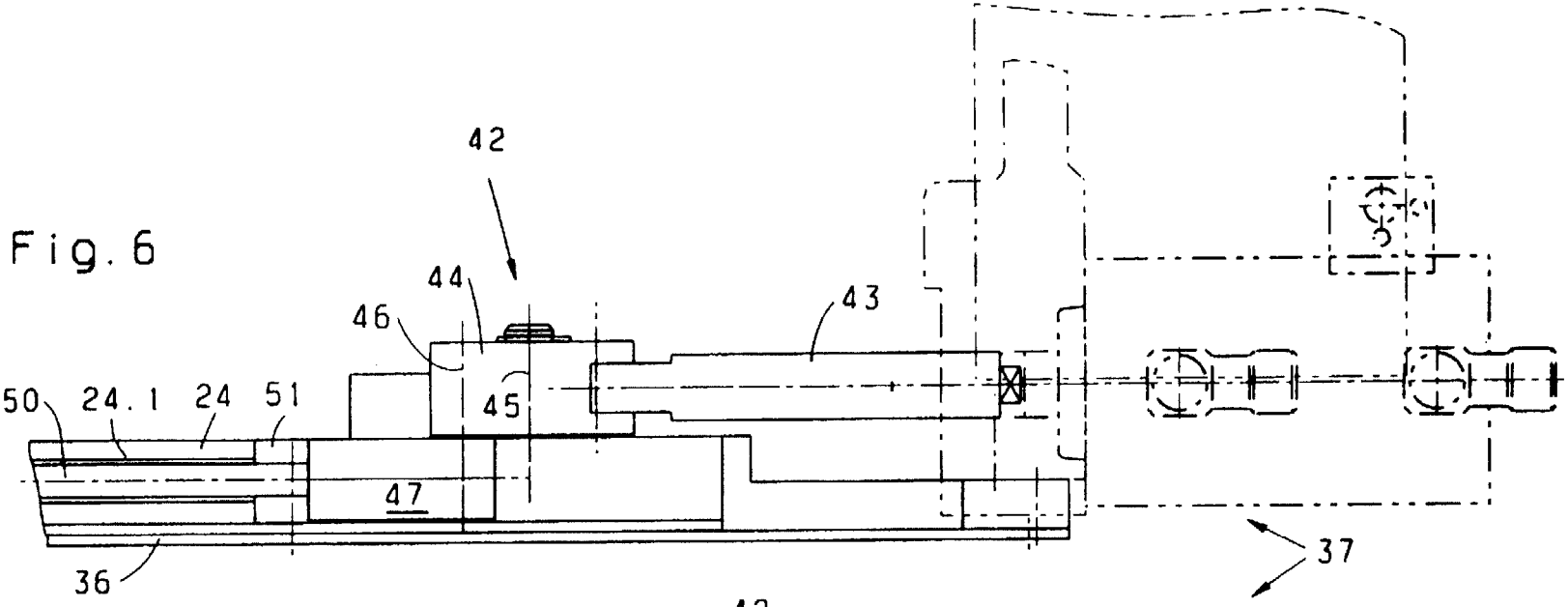
FIGS. 6 and 7 are respective enlarged fragmentary front elevational and top plan views of FIG. 5, showing an alternative construction for actuating the stops by a connecting rod and one of the regulating or operating cylinders.
Figure 7:
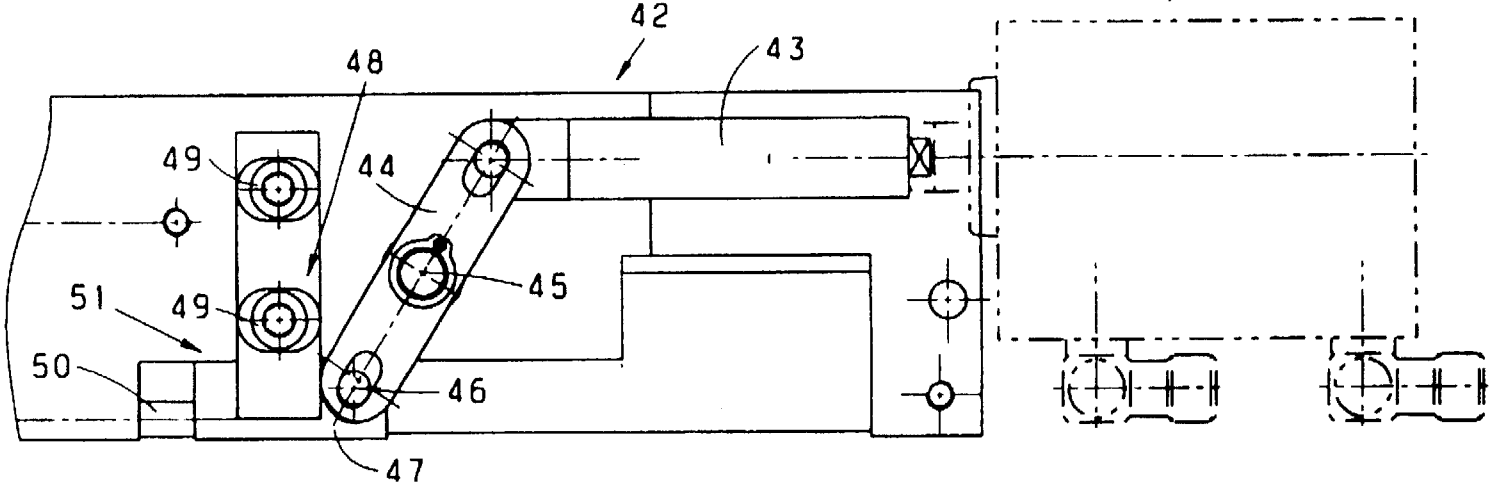

FIGS. 6 and 7 illustrate an alternative construction for actuating the stops 26.

With a push rod 43 displaceable by a regulating or control cylinder 37 and connected to a pivoting lever 44, a thrust or push element 47 is displaced in parallel on a guide surface 51 thereof. The pivoting lever 44 is pivotable about an axis 45 and connected both to the push rod 43 and, at an articulation 46, to the thrust or push element 47. Mounted displaceably on bolts 49 is a guide 48 which, as a stop, predetermines the stroke limitation of a bar 50. A connecting rod unit 42 transmitting the stroke movement includes the components made up of the push rod 43, the pivoting lever 44, the thrust or push element 47 and the bar 50 which is fastened thereto. With the bar 50 fastened to the thrust or push element 47, the individual stops 26 to be pivoted can be simultaneously pivoted without delay, for which purpose only one regulating or control cylinder 37 is required.

The alternative construction or different embodiment according to FIGS. 6 and 7 affords the advantage of making ready a delay-free direct actuation of the stops 26 acting in different planes.

The regulating or control cylinders 37 according to the various different embodiments for effecting the actuation in FIGS. 4, 5, 6 and 7 are connected to a pneumatic distributor 41 which activates the regulating or control cylinders 37 via a bistable valve and a monostable valve. With the monostable valve, the stops 26 are pivoted from the working position thereof into the rest position thereof (the position 26.1), so that the separating band can move into the working position. The advantage of the bistable valve is that it can bleed the regulating or control cylinder or cylinders 37 again when the stops 26 have moved downwardly into the operative position thereof. When a pallet, for example, is moved upwardly again and butts against the downwardly pivoted stops 26, the latter are not damaged, due to the bleeding of the regulating or control cylinder 37, and pivot into the horizontal position 26.1 thereof according to FIG. 4. On the other hand, the stops 26 can also be returned specifically into the horizontal position 26.1 at the pressing of a button by the monostable valve.

We claim:

1. A device for a format-dependent adjustment of cut-off length in a delivery region of a rotary printing press having a device for nonstop operation, with stops for the trailing edge of the sheets to be delivered, comprising a separating band revolving perpendicularly to the sheet transport direction, said separating band being integrated in a frame structure arranged so as to be displaceable in a horizontal direction, the stops for the sheet edge and a sheet-braking device being carried by the frame structure.

2. The device according to claim 1, including guiding elements for moving said frame structure on a horizontal guide.

3. The device according to claim 2, wherein said guiding elements are formed as runner rollers.

4. The device according to claim 2, wherein said horizontal guide member is formed with profiling.

5. The device according to claim 2, wherein said guiding elements are formed as a prismatic guidance structure.

6. The device according to claim 5, wherein said guiding elements are provided with needle cages.

7. The device according to claim 1, wherein the stops for the sheet edge are mounted on said frame structure.

8. The device according to claim 7, wherein the stops (26) for the sheet edge are pivotally mounted on said frame structure.

9. The device according to claim 1, wherein said frame structure includes a crossmember carrying the stops, and including a common actuating device connecting the stops to one another.

10. The device according to claim 9, wherein said common actuating device is a Bowden wire.

11. The device according to claim 9, wherein said common actuating device is a connecting rod.

12. The device according to claim 9, wherein said common actuating device is guidable in a longitudinal groove formed in said crossmember.

13. The device according to claim 9, wherein said common actuating device has pins provided thereon, said pins engaging in orifices formed in the stops.

14. The device according to claim 9, wherein said common actuating device has at least one regulating cylinder assigned thereto, said regulating cylinder being activatable via a bistable valve and a monostable valve.

15. The device according to claim 1, including deflecting rollers mounted within said frame structure, said separating band being revolvable on said deflecting rollers.

16. The device according to claim 1, wherein said frame structure includes side parts having projections serving as limit switch surfaces.

17. The device according to claim 1, wherein said frame structure is engageable with a sheet pile in a paper sheet travel direction.

* * * * *